United States Patent [19]

Lu et al.

[11] Patent Number: 4,851,316

[45] Date of Patent: Jul. 25, 1989

[54] LIQUID TONER COMPOSITIONS WITH AMINO ACIDS AND POLYVALENT METAL COMPLEXES AS CHARGE CONTROL ADDITIVES

[75] Inventors: Chin H. Lu, Fremont; Joseph S. Chow, San Jose, both of Calif.

[73] Assignee: Xerox Corporation, Stamford, Conn.

[21] Appl. No.: 137,640

[22] Filed: Dec. 24, 1987

[51] Int. Cl.[4] ..... G03G 9/12

[52] U.S. Cl. ..... 430/115

[58] Field of Search ..... 430/115, 110

[56] References Cited

U.S. PATENT DOCUMENTS 3,554,946 1/1971 Okumo et al. ..... 252/62.1
3,844,966 10/1974 Nelson ..... 252/62.1
4,014,856 3/1977 Gilliams et al. ..... 252/62.1 L
4,673,631 6/1987 Fukomoto et al. ..... 430/110
4,719,165 1/1988 Kitatani et al. ..... 430/110

FOREIGN PATENT DOCUMENTS 3529780 2/1986 Fed. Rep. of Germany .

OTHER PUBLICATIONS

Derwent Publications Ltd., 86-062880/10.

*Primary Examiner*—John L. Goodrow
*Attorney, Agent, or Firm*—E. O. Palazzo

[57] ABSTRACT

A positively charged liquid toner composition comprised of a liquid carrier vehicle component, binder resin particles, pigment particles; and a charge enhancing additive comprised of a lake complex obtained by the reaction of an amino acid and a polyvalent metal.

40 Claims, No Drawings

LIQUID TONER COMPOSITIONS WITH AMINO ACIDS AND POLYVALENT METAL COMPLEXES AS CHARGE CONTROL ADDITIVES

BACKGROUND OF THE INVENTION

This invention is generally directed to liquid toner compositions and more specifically to liquid toner compositions having incorporated therein, or thereon specific charge control additives. In one embodiment of the present invention there are provided liquid toner compositions containing therein, or thereon as charge enhancing additives complexes of amino acids and polyvalent metals as more specifically illustrated hereinafter. Another important embodiment of the present invention resides in improved liquid toner compositions useful in electrostatic printers and plotters, commercially available from Versatec, Inc. for example, which toner compositions are comprised of liquid media or liquid carriers, resin binders, pigment particles, and charge control additives selected from complexes of polyvalent metal compounds with amino acids, which additives are preferably present as a coating on the pigment particles. The aforementioned toner compositions possess a number of important characteristics inclusive of stable electrical properties, and wherein the charge additives selected are insoluble in the solvents and liquid vehicles selected for the toners; and moreover the liquid toners of the present invention enable final developed prints with excellent quality, that is substantially no background deposits, high density, and excellent solid area coverage. Accordingly, the particles in the liquid developer compositions of the present invention are positively charged, which charge is substantially stable for extended time periods, that is for example it does not usually decrease or increase with use; and moreover, the toner particles have excellent suspension properties, that is there is not tendency for such particles to settle or form agglomerates. Additionally, the toner compositions of the present invention possesses many of the characteristics mentioned herein at high printing speeds, that is up to two inches per second as well as low speeds such as 0.05 inch per second. Furthermore, the toner compositions of the present invention are useful in electrophotographic imaging apparatus, and more particularly the toners of the present invention can be selected for obtaining images of excellent quality in electrostatic plotters, inclusive of those commercially available from Versatec, Inc. Further, the liquid tones of the present invention may be selected for the development of images in various other systems, inclusive of xerographic processes, electrostatic printing, and facsimile systems; color proofing processes; and the like.

Development of electrostatic latent images with liquid developer compositions comprised of, for example, a dispersion of pigments in a liquid hydrocarbon are known. In these methods, the electrostatic latent image, which is usually formulated on a photoconductive member, is transported through a bath of the aforementioned liquid developer. Contact with the liquid developer causes the charged pigment particles present therein to migrate through the liquid to the photoreceptor surface in the configuration of a charged image. Thereafter, the toner electrostatic image is electrostatically transferred from the photoconductor surface to plain paper.

There are disclosed in U.S. Pat. No. 3,554,946 liquid developers for electrophotography comprised of a carrier liquid consisting of a hydrocarbon, negatively electrostatically charged toner particles dispersed in the carrier liquid, and a pigment therein such as carbon black, aniline black, prussian blue, phthalocyanine red, and cadmium yellow. In accordance with the teachings of this patent, a copolymer is coated on the surface of the pigment particles for the primary purpose of imparting a negative electrostatic charge to these particles. Other patents disclosing similar liquid developer compositions includes U.S. Pat. Nos. 3,623,986; 3,625,897; 3,900,412; 3,976,583; 4,081,391 and 3,900,412. In the '412 patent, there is disclosed a stable developer comprised of a polymer core with a steric barrier attached to the surface of the polymer selected. In column 15 of this patent, there are disclosed colored liquid developers by selecting pigments or dyes, and physically dispersing them by ball milling or high shear mixing.

Additionally, there is described in U.S. Pat. No. 4,476,210, the disclosure of which is totally incorporated herein by reference, liquid developers containing an insulating liquid dispersion medium with marking particles therein, which particles are comprised of a thermoplastic resin core substantially insoluble in the dispersion, an amphipathic block or graft copolymeric stabilizer irreversibly chemically, or physically anchored to the thermoplastic resin core, and a colored dye imbibed in the thermoplastic resin core. The history and evolution of liquid developers is provided in the '210 patent, reference columns 1 and 2 thereof.

In addition, there are illustrated in British Patent Publication No. 2,169,416, the disclosure of which is totally incorporated herein by reference, liquid developer compositions comprising toner particles associated with a pigment dispersed in a nonpolar liquid, and wherein the toner particles are formulated with a plurality of fibers or tendrils from a thermoplastic polymer, and carry a charge of polarity opposite to the polarity of the latent image. These toners permit in some instances excellent transfer efficiencies, however, they are apparently difficult to prepare.

Representative prior art patents primarily of background interest are U.S. Pat. Nos. 4,306,009; 4,363,863; 4,374,918 and 4,521,505. The main disadvantage associated with the aforementioned prior art inks resides in the release or evaporation of the vehicle selected, such as Isopar since these toners are prepared in a manner that does not result in the entrapment of the vehicle.

Also, there are described in U.S. Pat. No. 4,014,856 liquid toners comprising carrier liquids and toner particles wherein the carrier liquid comprises a bivalent or trivalent metal salt of an oxyacid derived from phosphorus containing at least one organic residue, and one or more members selected from the group consisting of amines, polyurethanes, and alkylated polymers of a heterocyclic N-vinyl monomer wherein the polarity of the toner material is controlled for the purpose of obtaining optimum image density and contrast, reference the abstract of the disclosure. It is further indicated in this patent that when carbon blacks are used as the toner material it is possible to control the polarity to obtain either positive or negative working toner compositions. Specific embodiments of the invention of the '856 patent are outlined in column 2, beginning at line 34, and continuing on to column 3. Examples of components selected for the toners of this patent are described in column 4. This patent, however, is silent with respect to liquid toner compositions which contain therein the specific charge control additives of the present invention, and which enable some of the advantages achievable with such charge control additives.

Disclosed in U.S. Pat. No. 3,844,966 are electrostatic liquid toner compositions comprised of a carrier liquid with toner particles suspended therein, and also containing a trivalent or tetravalent metal salt of an organic acid plus an organic amine dissolved in the carrier, reference the Abstract, and column 1, lines 56 to 64. Examples of suitable metal salts selected for the toner of this patent are outlined in column 2, beginning at line 22, and include trivalent and tetravalent cation salts of aluminum, iron, salts of organic acids, and the like. Second additive examples include any organic amine, such as ammonia, and other materials including organic acid esters, reference column 2, lines 32 to 64.

In addition, there are illustrated in German Published Application No. 3,529,780 liquid electrostatic developers containing charge regulators therein which are formulated by reacting an amino acid in an organic solvent with a titanium compound, and mixing and reacting the reaction mixture with an amount of water at least equimolar to the titanium compound, reference the Derwent abstract, a copy of which is being submitted with the mailing of this application to the U.S. Patent Office. Examples of preferred components selected are outlined in the abstract, and moreover it is indicated that the liquid developer enables excellent unblurred copies of high quality.

Furthermore, there are illustrated in copending application U.S. Ser. No. 846,164, the disclosure of which is totally incorporated herein by reference, stable black liquid developers comprised of an insulating liquid medium having dispersed therein black marking particles comprised of a thermoplastic resin core which is substantially insoluble in the dispersion medium, and chemically or physically anchored to the resin core an amphipathic block or graft copolymer steric stabilizer which is soluble in the dispersion medium; and wherein dyes comprised of a specific mixture are imbibed in the thermoplastic resin core with the mixture of dyes being dispersible at the molecular level, and therefore soluble in the thermoplastic resin core and insoluble in the dispersion medium. Furthermore, in U.S. Pat. No. 4,762,764, the disclosure of which is totally incorporated herein by reference, there is illustrated dyed sterically stabilized polymer particle for incorporation into negatively charged electrophoretic liquid developers.

Although the above described liquid toners are suitable for their intended purposes, there remains a need for improved ink compositions. There also is a need for ink compositions with stable electrical properties, and wherein the charge enhancing additive is permanently associated with the toner composition. Additionally, there is a need for liquid inks, or toner compositions wherein there are selected certain charge control additives thereby enabling such compositions to possess stable electrical properties for extended time periods. Moreover, there is a need for positively charged liquid toner compositions wherein the charge control additives are present as a coating on the pigment particles. Further, there remains a need for liquid toner compositions with complexes of amino acids with polyvalent metals as charge control components, which additives are insoluble in the liquid carrier and are substantially insulating and not conductive in comparison to prior art charge control materials. In this regard, most known charge control agents are soluble in the carrier, and they are also conductive. Toners containing soluble charge control agents usually have resistivity lower than $10^9$ ohm-cm, whereas the toners of the present invention, which contain insoluble charge control agents, usually have a higher resistivity of greater than $10^{10}$ ohm-cm. There is also a need for toner compositions wherein the charge enhancing additive is insoluble in the solvents utilized thus enabling the resulting compositions to possess desirable characteristics as mentioned herein, including the formulation of developed images of excellent quality of high density, and low background deposits. Additionally, there is a need for liquid toner compositions wherein the charge control additive selected is insoluble in the carrier liquid thus enabling, for example, toners with relatively high resistivities, that is greater than $10^{10}$ ohm-cm as contrasted, for example, to some of the prior art liquid toners wherein the charge control agents are soluble in the carrier vehicle, and there results toners with resistivities of lower than $10^9$ ohm-cm.

SUMMARY OF THE INVENTION

It is an object of the present invention to provide liquid toner compositions with many of the above noted advantages.

In another object of the present invention there are provided liquid toner ink compositions having incorporated therein as charge additives complexes of amino acids and polyvalent metals.

In yet another object of the present invention there are provided processes for liquid developer compositions with superior transfer efficiencies.

It is an additional object of the present invention to provide ink or toner compositions wherein the charge enhancing additive selected is present as a coating on the pigment particles.

Furthermore, in another object of the present invention there are provided liquid ink compositions having incorporated therein or thereon charge control additives, which compositions possess stable electrical characteristics, and are substantially insulating.

Moreover, another object of the present invention resides in the provision of liquid toner compositions that can be selected for electrostatic printers and plotters, and wherein there results images of excellent quality with low background deposits, and high density characteristics.

Additionally, in another object of the present invention there are provided positively charged liquid toner compositions.

Also, in another object of the present invention there are provided liquid toner compositions wherein the charge enhancing additive is insoluble in the liquid carrier thereby enabling toners with resistivities of greater than $10^{10}$ ohm-cm.

These and other objects of the present invention are accomplished by providing positively charged liquid ink, or toner compositions useful in electrophotographic imaging and printing processes, and particularly electrostatic printers and plotters, which compositions are comprised of a liquid carrier, resin binders, pigment particles and charge enhancing additives comprised of certain complexes of amino acids and polyvalent metal compounds. More specifically, in one embodiment the present invention is directed to positively charged liquid inks or toner compositions comprised of a liquid carrier, pigment particles, resin binders, dispersing additives, and charge enhancing additives comprised of certain complexes of amino acids I, and polyvalent metal compounds II of the following formulas:

I. amino acids of the following formula

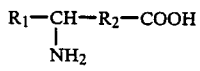

wherein $R_1$ is a hydrogen, a hydrocarbon of from 1 to about 22 carbon atoms, inclusive of alkyl such as methyl, ethyl, propyl, and butyl, or a hydroxylated hydrocarbon of from 1 to about 22 carbon atoms; $R_2$ is an alkylene group of hydroxylated alkylene of from zero (0) to about 22 carbon atoms. Examples of amino acids are coco-beta-aminobutyric acid, tallow-beta-aminobutyric acid, coco-alpha-aminobutyric acid, coco-gamma-aminobutyric acid, coco-alpha-aminopropionic acid, coco-betaamino-propionic acid, soya-beta-aminobutyric acid, octadecyl-betaaminobutyric acid, hexadecyl-beta-aminobutyric acid, dodecyl-alphaaminopropionic acid, tetradecyl-alpha-amino-beta-hydroxy-butyric acid, and the like.

II. polyvalent metal compounds of the following formula:

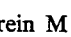

wherein M is a polyvalent cation such as aluminum, chromium, calcium, cobalt, magnesium, manganese, nickel, iron, zinc, titanium, zirconium, and the like; A is an anion such as chloride, bromide, iodide, chlorate, nitrate, sulfate, phosphate, chromate, and the like; and x and y are numbers of from 1 to 4. Examples of polyvalent metal compounds are aluminum chloride, aluminum nitrate, aluminum bromide, chromium chloride, chromium nitrate, chromium chlorate, magnesium chloride, magnesium nitrate, titanium chloride, zirconium chloride, and the like.

Examples of pigment particles present in an amount of, for example, from about 0.2 to about 20 percent by weight that may be selected for the toner compositions of the present invention include carbon blacks, lamp blacks, magnetites, metal oxides; organic pigments such as phthalocyanines; Litho Rubine, Lithol Scarlett, Diarylide Yellow, Sico Yellow; lake pigments, such as Rhodamine Lake, Crystal Violet Lake, Morfast Blue 100, Morfast Red 101, Morfast Red 104, Morfast Yellow 102, Morfast Black 101, available from Morton Chemical Limited, Ajax, Ontario, Canada; Savinyl Yellow RLS, Savinyl Yellow 2RLS, Savinyl Pink 6BLS, Savinyl Red 3BLS, Savinyl Red GL5, Savinyl Black RLS, available from Sandoz, Mississauga, Ontario, Canada; Neozapon Black X57 available from BASF, Toronto, Ontario, Canada; and Astrophlozine FF, available from Hodogaya Chemical Company. Other similar dyes can be selected providing the objectives of the present invention are achieved.

As resinous polymeric binders present in an amount of from about 0.2 to about 40 percent by weight there can be selected for the compositions of the present invention acrylics, hydrocarbon resins, vinyl toluene polymers, vinyl toluene-butadiene copolymers, vinyl toluene/acrylic copolymers, styrene-acrylic copolymers, styrene methacrylates, styrene butadienes, and the like. Other binders can be selected providing the objectives of the present invention are achievable.

Liquid carrier vehicles present in an amount of from about 40 to about 99 percent by weight include the various known Isopars, such as Isopar® G and L.

The toner compositions of the present invention are prepared by various suitable methods, such as the simple mixing of the components with slight heating, followed by filtration.

Also, the ink compositions of the present invention are particularly useful in liquid development systems, such as those illustrated in the aforementioned '146 British Patent Publication, and color proofing processes. More specifically, these processes involve depositing an electrostatic charge pattern on a media, such as a paper or a film, and then toning the electrostatic image with the liquid developers of the present invention. In addition, the liquid developer compositions formulated in accordance with the processor of the present invention are also useful for enabling the development of colored electrostatic latent images particularly those contained on an imaging member charged negatively. Examples of imaging members that may be selected include various known organic photoreceptors including layered photoreceptors. Illustrative examples of layered photoresponsive members include those with a substrate, a photogenerating layer, and a transport layer as disclosed in U.S. Pat. No. 4,265,990, the disclosure of which is totally incorporated herein by reference. Examples of photogenerating layer pigments are trigonal selenium, metal phthalocyanines, metal free phthalocyanines, and vanadyl phthalocyanine. Transport material examples include various diamines dispersed in resinous binders. Other organic photoresponsive materials that may be utilized in the practice of the present invention include polyvinyl carbozole; 4-dimethylaminobenzylidene, benzhydrazide; 2-benzylidene-amino-carbazole, (2-nitro-benzylidene)-p-bromoaniline; 2,4-diphenyl-quinazoline; 1,2,4-triazine; 1,5-diphenyl-3-methyl pyrazoline 2-(4'-dimethyl-amino phenyl)-benzoxazole; 3-amino-carbazole; polyvinylcarbazole-tritrofluorenone charge transfer complex; and mixtures thereof. Further, imaging members that can be selected are selenium and selenium alloys, zinc oxide, cadmium sulfide, hydrogenated amorphous silicon, as well as ionographic surfaces of various dielectric materials such as polycarbonate polysulfone fluoropolymers, anodized aluminum alone or filled with wax expanded fluoropolymers, and the like.

The following examples are being supplied to further define specific embodiments of the present invention, it being noted that these examples are intended to illustrate and not limit the scope of the present invention. Parts and percentages are by weight unless otherwise indicated.

EXAMPLE I

Thirty grams of Armeen Z, a N-coco-beta-aminobutyric acid solution (about 50 percent solid), commercially available from Akzo Chemie America Company, was blended with 200 grams of isopropyl alcohol and 200 grams of deionized water. One hundred grams of Regal® 330 carbon black commercially available from Cabot Corporation was added to the solution. The mixture was milled in a jar mill for 20 hours. To 500 grams of the slurry was slowly added a solution containing about 22.4 grams $AlCl_3 \cdot 6H_2O$, and 100 grams of deionized water with vigorous stirring. After the addition of the aluminum chloride solution, the slurry was heated to 66°±2° C. for 30 minutes. The mixture was allowed to cool and filtered, and the filter cake resulting was reslurried with isopropyl alcohol/water solution (1:1 by weight), filtered, and dried at about 100° C. for 20 hours. The clumps obtained were broken up with a spatula.

Two toners of the following compositions were then prepared by jar milling and mixing. Toner A contained untreated carbon black and was used as a control. Toner B had the identical composition as Toner A except treated carbon black prepared by the above method and containing the complex lake charge enhancing additive was selected.

| | Toner A (Control) (Parts) | Toner B (Parts) |
|---|---|---|
| Regal ® 330 (untreated) | 15 | 0 |
| Regal ® 330 (treated) | 0 | 15 |
| Zirex | 5 | 5 |
| EX 519 | 20 | 20 |
| Isopar ® G | 110 | 110 |

Regal ® 330 is a carbon black available from Cabot Corporation; Zirex is a zinc resinate available from Reichhold Chemicals, Inc; and EX 519 is an acrylics copolymer dispersion (about 47 percent solid) available from Polyvinyl Chemical Industries. Isopar ® G is an isoparaffinic hydrocarbon solvent available from Exxon Company.

The toners were diluted with Isopar ® G to about 0.5 percent solids concentration and tested for plate-out in a constant direct current electric field. The plate-out cell was approximately 4×4×1 cm in dimensions. It consisted of two stainless steel electrode plates held 1 cm apart. Exactly 10 milliliters of each of the above prepared toners of about 0.5 percent solids concentration were placed in the cell. A constant direct current voltage of 800 volts was applied for 1 minute. Toner or pigment particles were deposited on the electrode plate of opposite polarity during the plating. The materials deposited on the plate were dried, and the mass collected was as follows the polarity sign indicating the polarity of the toner particles.

| | Mass of Plate-Out, mg at 800 V, 1 minute |
|---|---|
| Toner A (control) | +3.6 |
| Toner B | +7.4 |

The plate-out for Toner B, which contained treated carbon black, was significantly higher than the control Toner A, which contained untreated carbon black. Both toners were tested in a Versatec V-80 plotter with the latent image charged negatively. Toner B produced excellent prints with a sharp image of 400 dots per inch, a high density of 1.4, and low background, while control Toner A produced prints of substantially lower quality that is with an optical density of 1.0,. and a lower resolution of about 175 dots per inch.

EXAMPLE II

Two toners were prepared by the process of Example I with the exception that one more ingredient, a dispersing agent, was added. Toner C contained the untreated carbon black and was used as a control. Toner D contained the treated carbon black described in Example I. The compositions of these toners were as follows:

| | Toner C (Control) (Parts) | Toner D (Parts) |
|---|---|---|
| Regal ® 330 (untreated) | 15 | 0 |
| Regal ® 330 (treated) | 0 | 15 |
| Zirex | 5 | 5 |
| EX 519 | 20 | 20 |
| FOA-2 | 5 | 5 |
| Isopar ® G | 105 | 105 |

FOA-2 is a dispensing agent of a methacrylate polymer solution (about 50 percent solid) available from E. I. DuPont Company.

Plate-out tests of the premixed toners at 0.5 percent solids concentration were conducted with the following results.

| | Mass of Plate-Out, mg at 800 V, 1 minute |
|---|---|
| Toner C (control) | −2.2 |
| Toner D | +10.5 |

Toner C had a negative polarity and Toner D had positive polarity. Also, Toner D was tested in a Versatec V-80 plotter and a Versatec 8000 plotter with negatively charged latent image. Prints of excellent quality similar to those of Example I were obtained from both plotters. Toner C was not tested as it possessed the wrong polarity.

EXAMPLE III

Toner E was prepared by jar milling in accordance with the process of Example I. The composition of Toner E was similar to Toner D described in Example II except the treated carbon black used had a lower coating weight of amino acid and polyvalent metal complex. The carbon black used in this toner was treated by the method described in Example I except a complex consisting of 10 grams of Armeen Z and 7.5 grams of $AlCl_3 \cdot 6H_2O$ was selected. The mass of plate-out of the premix toner at 0.5 percent solids concentration was +7.0 milligrams. The toner was tested in a Versatec V-80 plotter, and substantially similar imaging results as in Example I were obtained.

EXAMPLE IV

Toner F of the following composition was prepared by jar milling in accordance with the process of Example I.

| | Toner F (Parts) |
|---|---|
| Regal ® 330 (treated by method described in Example 1) | 15.0 |
| Zirex | 5.0 |
| EX 519 | 18.9 |
| OLOA 1200 | 1.0 |
| Isopar ® G | 111.1 |

OLOA 1200 is a succinimide dispersant available from Chevron Chemical Company. The toner was diluted with Isopar ® G to about 0.5 percent solids concentration. Plate-out mass of the premix toner was +9.8 milligrams. The toner was tested in a Versatec V-80 plotter, and substantially similar imaging results as in Example I were obtained.

EXAMPLE V

Regal ® 330 carbon black was treated by the method described in Example I with the exception that for the charge additive complex there was selected 24.7 grams of $CrCl_3 \cdot 6H_2O$ in place of 22.4 grams of $AlCl_3 \cdot 6H_2O$. Toner G of the following composition was then prepared by jar milling by repeating the process of Example I.

| | Toner G (Parts) |
|---|---|
| Regal ® 330 (treated by method described in this example) | 15.0 |
| Zirex | 5.0 |
| EX 519 | 18.9 |
| OLOA 1200 | 1.0 |
| Isopar ® G | 111.1 |

The toner was diluted to 0.5 percent solids concentration with Isopar ® G. Plate-out test showed +6.5 milligrams of materials was deposited on the electrode. Good quality prints, that is substantially similar to those of Example I, were obtained when this toner was tested in a Versatec V-80 plotter.

EXAMPLE VI

Toner H and Toner K of the following compositions were prepared by jar milling by repeating the process of Example I.

| | Toner H (Parts) | Toner K (Parts) |
|---|---|---|
| Regal ® 330 (treated by method described in Example I) | 15.0 | 19.5 |
| S1004 | 25.0 | 25.0 |
| Zinol | 3.9 | 3.9 |
| Isopar ® G | 106.1 | 124.1 |

S1004 is an acrylics copolymer solution (about 500 percent solid) available from Polyvinyl Chemical Industries. Zinol is a zinc resinate solution (about 64 percent solid) available from Reichhold Chemicals, Inc. Plate-out tests of these toners at about 0.5 percent solids concentration were conducted with the following results:

| | Mass of Plate-Out, mg at 800 V, 1 minute |
|---|---|
| Toner H | +12.8 |
| Toner K | +11.3 |

The above formulated toners H and K were then tested in a Versatec V-80 plotter and excellent quality prints substantially similar to those obtained in Example I resulted.

Other modifications of the present invention will occur to those skilled in the art subsequent to a review of the present application. These modifications, and equivalents thereof are intended to be included within the scope of this invention.

What is claimed is:

1. A positively charged liquid toner composition comprised of a liquid carrier vehicle component, binder resin particles, pigment particles, and a charge enhancing additive comprised of a lake complex obtained by the reaction of an amino acid and a polyvalent metal, which charge enhancing additive is insoluble in the liquid carrier vehicle component.

2. A toner composition in accordance with claim 1 wherein the amino acid selected is of the formula $R_1—CHNH_2—R_2—COOH$, wherein $R_1$ is an alkyl group, or a hydroxylated alkyl group; and $R_2$ is an alkylene substituent, or a hydroxylated alkylene substituent.

3. A toner composition in accordance with claim 1 wherein the polyvalent metal is of the formula $$M_xA_y$$

wherein M is a polyvalent cation, A is an anion, and x and y are numbers of from 1 to about 4.

4. A toner composition in accordance with claim 1 wherein the amino acid is selected from the group consisting of coco-beta amino butyric acid, tallow-beta-aminobutyric acid, coco-alpha-amino-butyric acid, coco-gamma-aminobutyric acid, coco-alpha-amino-propionic acid, coco-beta-amino-propionic acid, soya-beta-aminobutyric acid, octadecyl-beta-aminobutyric acid, hexadecyl-beta-aminobutyric acid, dodecyl-alphaaminopropionic acid, and tetradecyl-alpha-amino-beta-hydroxy-butyric acid.

5. A toner composition in accordance with claim 3 wherein M is selected from the group consisting of aluminum, chromium, calcium, cobalt, magnesium, manganese, nickel, iron, zinc, titanium, and zirconium.

6. A toner composition in accordance with claim 1 wherein the anion is selected from the group consisting of chloride, bromide, iodide, chlorate, nitrate, sulfate, phosphate, and chromate.

7. A tone composition in accordance with claim 1 wherein the pigment particles are present in an amount of from about 0.2 percent to about 20 percent by weight.

8. A toner composition in accordance with claim 1 wherein the resinous polymeric binders are selected from the group consisting of acrylics, hydrocarbon resins, vinyl toluene polymers, vinyl toluene/butadiene copolymers, vinyl toluene/acrylic copolymers, styrene acrylates, and styrene methacrylates.

9. A toner composition in accordance with claim 1 wherein the resinous binder is present in an amount of from about 0.2 percent to about 40 percent.

10. A toner composition in accordance with claim 1 wherein the liquid vehicle is Isopar ®.

11. A toner composition in accordance with claim 1 containing a dispersant component therein.

12. A toner composition in accordance with claim 1 wherein the pigment particles containing thereover a coating of the charge enhancing additive complex lake.

13. A toner composition in accordance with claim 12 wherein the amino acid selected is of the formula $R_1—CHNH_2—R_2—COOH$, wherein $R_1$ is an alkyl group, or a hydroxylated alkyl group; and $R_2$ is an alkylene substituent, or a hydroxylated alkylene substituent.

14. A toner composition in accordance with claim 13 wherein the alkyl group contains from 1 to about 22 carbon atoms.

15. A toner composition in accordance with claim 12 wherein the polyvalent metal is selected from the group consisting of aluminum, chromium, calcium, cobalt, magnesium, manganese, nickel, iron, zinc, titanium, and zirconium.

16. A toner composition in accordance with claim 12 wherein the polyvalent metal is of the formula $$M_xA_y$$

wherein M is a polyvalent cation, A is an anion, and x and y are numbers of from 1 to about 4.

17. A toner composition in accordance with claim 16 wherein the anion A is a halide.

18. A toner composition in accordance with claim 17 wherein the anion is selected from the group consisting of sulfate, nitrate, phosphate, chlorate, and chromate.

19. A toner composition in accordance with claim 12 wherein the pigment particles are comprised of carbon black.

20. A toner composition in accordance with claim 12 wherein the pigment particles are comprised of magnetites.

21. A toner composition in accordance with claim 12 wherein the pigment particles are selected from the group consisting of cyan, magneta, yellow, and mixtures thereof.

22. A toner composition in accordance with claim 12 wherein the liquid vehicle carrier is a hydrocarbon.

23. A toner composition in accordance with claim 12 wherein the toner includes therein a dispersing additive.

24. A toner composition in accordance with claim 12 wherein the resin particles are acrylics.

25. A toner composition in accordance with claim 12 wherein the resin particles are vinyl toluene/acrylic copolymers.

26. A toner composition in accordance with claim 12 wherein the resin particles are vinyl toluene/butadiene copolymers.

27. A toner composition in accordance with claim 1 wherein the resistivity thereof is greater $10^{10}$ ohm-cm.

28. A method of imaging which comprises the formation of an image on an electrographic medium in an electrostatic plotter device, and thereafter developing this image with the liquid toner composition of claim 1.

29. A method of imaging which comprises the formation of an image on an electrographic medium in an electrostatic plotter device, and thereafter developing this image with the liquid toner composition of claim 12.

30. A method of imaging in accordance with claim 28 wherein there is selected for the toner composition resin particles selected from the group consisting of acrylics, hydrocarbon resins, vinyl toluene polymers, vinyl toluene/butadiene copolymers, vinyl toluene acrylate copolymers, styrene acrylates, and styrene methacrylates.

31. A method of imaging in accordance with claim 28 wherein the toner composition contains as the liquid carrier Isopar ®.

32. A method of imaging in accordance with claim 28 wherein the toner composition contains as pigment particles carbon black.

33. A method of imaging in accordance with claim 28 wherein the amino acid for the complex lake is coco-beta amino butyric acid, tallow-beta-aminobutyric acid, coco-alpha-aminobutyric acid, coco-gamma-aminobutyric acid, coco-alpha-amino-propionic acid, coco-beta-amino-propionic acid, soya-beta-aminobutyric acid, octadecyl-beta-aminobutyric acid, hexadecyl-beta-aminobutyric acid, dodecyl-alpha-aminopropionic acid, or tetradecyl-alpha-amino-beta-hydroxy-butyric acid.

34. A method of imaging in accordance with claim 28 wherein the polyvalent metal is aluminum chloride.

35. A toner composition in accordance with claim 1 wherein the polyvalent metal is selected from the group consisting of aluminum, chromium, calcium, cobalt, magnesium, manganese, nickel, iron, zinc, and zirconium.

36. A toner composition in accordance with claim 1 wherein the polyvalent metal is selected from the group consisting of aluminum and chromium.

37. A toner composition in accordance with claim 1 wherein the polyvalent metal is aluminum.

38. A toner composition in accordance with claim 12 wherein the polyvalent metal is selected from the group consisting of aluminum, chromium, calcium, cobalt, magnesium, manganese, nickel, iron, zinc, and zirconium.

39. A toner composition in accordance with claim 12 wherein the polyvalent metal is selected from the group consisting of aluminum and chromium.

40. A toner composition in accordance with claim 12 wherein the polyvalent metal is aluminum.

* * * * *